US005180011A

United States Patent [19]

Wittrisch

[11] Patent Number: 5,180,011

[45] Date of Patent: Jan. 19, 1993

[54] METHOD AND DEVICE FOR CARRYING OUT MEASURING OPERATIONS OF INTERVENTIONS IN A WELL

[75] Inventor: Christian Wittrisch, Rueil-Malmaison, France

[73] Assignee: Institut Francais du Petrole, Rueil-Malmaison, France

[21] Appl. No.: 720,367

[22] Filed: Jun. 25, 1991

[30] Foreign Application Priority Data

Jun. 25, 1990 [FR] France ..... 90 07956

[51] Int. Cl.[5] ..... E21B 47/00

[52] U.S. Cl. ..... 166/250; 166/65.1; 175/50

[58] Field of Search ..... 166/250, 65.1, 66, 162, 166/242, 243; 175/40, 50; 73/151, 152

[56] References Cited

U.S. PATENT DOCUMENTS 4,570,709 2/1986 Wittrisch ..... 166/250
4,664,189 5/1987 Wittrisch ..... 166/250
4,690,214 9/1987 Wittrisch ..... 166/65.1 X
4,945,987 8/1990 Wittrisch ..... 166/65.1 X

*Primary Examiner*—Terry Lee Melius
*Attorney, Agent, or Firm*—Antonelli, Terry, Stout & Kraus

[57] ABSTRACT

Measuring operations can for example be carried out in wells (1) where the progress of an intervention tool (3) is difficult (deflected wells for example) by means of a tubing (2), a support frame (5) linked with the tool and which can be anchored in the lower end part of the tubing, an electric-carrying cable (12) unwound from a surface installation and fitted with a connector (9, 11) that can plug into the support frame in a wet medium after the tool has been taken down into the well, in order to tightly link the tool to the cable. The base of the tubing is fitted with a piping end (18) allowing the support frame to come out of it. With this device, the tool can be driven to the intervention zone by exerting a thrust on the tubing and, once the connector is in place, the tubing can be totally taken away from this zone and continuous measurings can be carried out by traction on the cable.

5 Claims, 3 Drawing Sheets

METHOD AND DEVICE FOR CARRYING OUT MEASURING OPERATIONS OF INTERVENTIONS IN A WELL

BACKGROUND OF THE INVENTION

The present invention relates to an improved method and device for carrying out measuring operations or interventions in wells and notably in wells drilled through petroliferous zones. These measurings can be achieved within the framework of seismic prospecting operations or to carry out local studies of a well or of the surrounding formations. The method and the device are particularly suitable for carrying out measuring operations in deflected wells, this term referring to wells at least part of which is more or less deflected in relation to the vertical, or more generally any well where the progress of a measuring tool by gravity is difficult.

European Patent EP 296 209 or U.S. Pat. No. 4,945,987 describe a method and a device for carrying out interventions such as measurings in wells which are particularly suitable when these interventions are to be achieved in deflected wells.

The measuring or intervention tool is arranged at the base of a first section of a pipe constituting the end part of a stiff tubing. It is linked to a support frame fitted with removable retaining means through which it can be made interdependent with the end part of the tubing and with a multicontact plug. The retaining means are locked in order to make the support frame interdependent with this section. Through successive additions of sections, the measuring or intervention tool is taken down and pushed along the well until it reaches the upper limit of the zone where the interventions are to be carried out. A socket topped by a weighting bar is introduced by means of a side-entry sub and driven by a current of fluid to a multicontact plug where it is plugged in. Supplementary pipe sections are added in order to push the tool until it reaches the location where the measurings are planned to begin. The tool is fitted with anchoring arms which are opened to immobilize it in the well and several sections of the tubing are taken up in order to move the tool away from its base. The support frame rests then against a thrust at the lower end of the tubing. The measurings can then be carried out either discontinuously by displacing the tool from one location to another after each measuring, while making the tool cling to the wall of the well with the anchoring arms open, or continuously within more or less narrow limits according to the extent of the withdrawal of the tubing.

Displacing the tool can be performed in all cases by a traction on the tubing, and since the latter has to be shortened section by section as it is withdrawn, it becomes obvious that the maximum length on which a continuous move is possible is limited to the length of the utilized sections.

The method according to the invention allows to get free from these limitations.

SUMMARY OF THE INVENTION

As in the method described in the patent mentioned above, the improved method according to the invention comprises the use of a stiff tubing comprising an inserted side-entry sub, of an intervention assembly or consisting for example of one or several tools or measuring instruments, positioning or holding this intervention assembly in a first position at a first end of a stiff tubing by a support frame fitted with removable locking means, introducing into the well the intervention assembly associated with said first end, taking down the intervention assembly into the well by lengthening said tubing until a zone where measurings or interventions are planned is reached, the delayed electric connection of the intervention assembly with an electric-carrying cable unwound from a surface installation, which goes from the outside to the inside of the stiff tubing through the entry of said side-entry sub, displacing said intervention assembly from the first position to a second position where it is moved away from said first end, and immobilizing on request the intervention assembly in the well by anchoring against the walls of the latter.

The method also comprises:

using a electric connection means with a delayed plugging fitted with locking elements allowing to make the electric-carrying cable and the support frame, after said support frame has been taken down into the well, interdependent on request, and a stiff tubing fitted with a piping end with a section sufficient to let the support frame linked to said electric connection means get totally out of the stiff tubing when said intervention assembly is displaced towards said second position;

withdrawing the tubing after anchoring the intervention assembly in the well on the total length of the measuring or intervention zone, said intervention assembly being directly linked with the surface installation by means of said electric-carrying cable; and withdrawing the intervention assembly until reaching said first position by a traction exerted on the cable by surface operating means, until the support frame has totally returned into the stiff tubing and is locked.

The device according to the invention allows to carry out interventions or measuring operations in wells. It comprises a stiff tubing fitted with a side-entry sub, an intervention assembly comprising for example one or several measuring instruments and anchoring means allowing to immobilize the intervention in the well, a support frame associated with said intervention by linking means and displaceable within the tubing between a first position where the intervention rests against a first end of the tubing and a second position, the support frame being fitted with fastening means allowing to lock the support frame against the tubing in the first position thereof, these fastening means being remote-controlled from a surface installation and going from the outside to the inside of the stiff tubing through the side-entry sub, a multiwire electric-carrying cable linked to a surface control and acquisition assembly, and a system for the delayed connecting of said cable to the intervention assembly after said intervention has been taken down into the well.

The device is characterized in that:

the tubing is fitted at its first end with a piping end with a section sufficient to let the frame support get totally out of the tubing when the fastening means are in the unlocked position;

the delayed connection system comprises a connector that can be plugged in a wet medium and locking means that can be remote-controlled from the surface installation to fasten the connector to the support frame in the plug-in position, and means for limiting the access to the fastening means and to the locking means of solid fragments likely to hinder operating thereof.

The structure of the device allows to lengthen as much as wanted the intervention zone continuously, without being limited as in the prior method by the length of the sections of the pushing tubing, and thereby possibly to carry out interventions in a regular way without being hindered by periodic maneuvers of shortening of the stiff tubing for example.

BRIEF DESCRIPTION OF THE DRAWINGS

Other features and advantages of the method and the device according to the invention will be clear from reading the description hereafter of the embodiment procedures given by way of non limitative examples, with reference to the accompanying drawings in which.

DESCRIPTION OF THE PREFERRED EMBODIMENTS

A tubing 2 is taken down into a well 1 to carry out interventions. An intervention assembly 3, which can be for example a logging tool, is adapted at the lower end of tubing 2.

Figure 1:
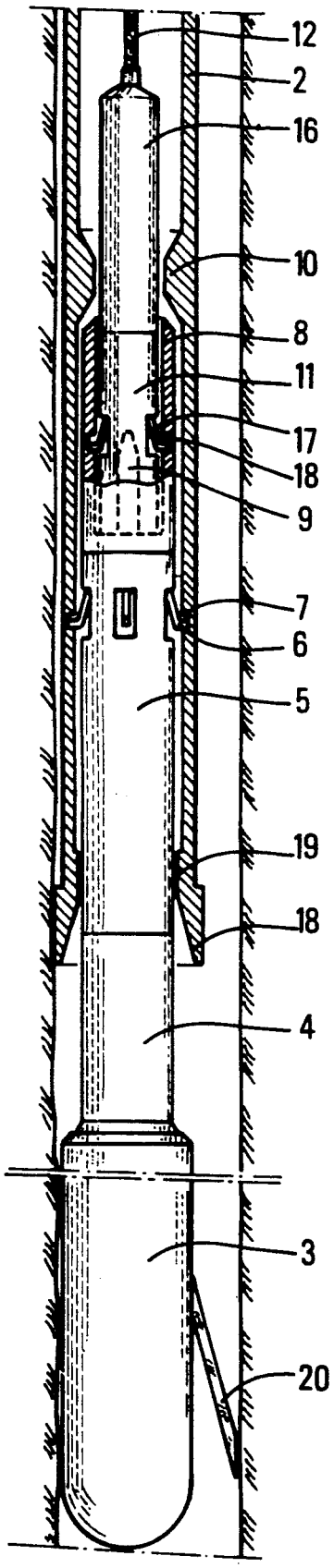
FIG.1 diagrammatically shows an embodiment procedure of the device where the tool is linked to its support frame by a stiff connection.
Figure 2:
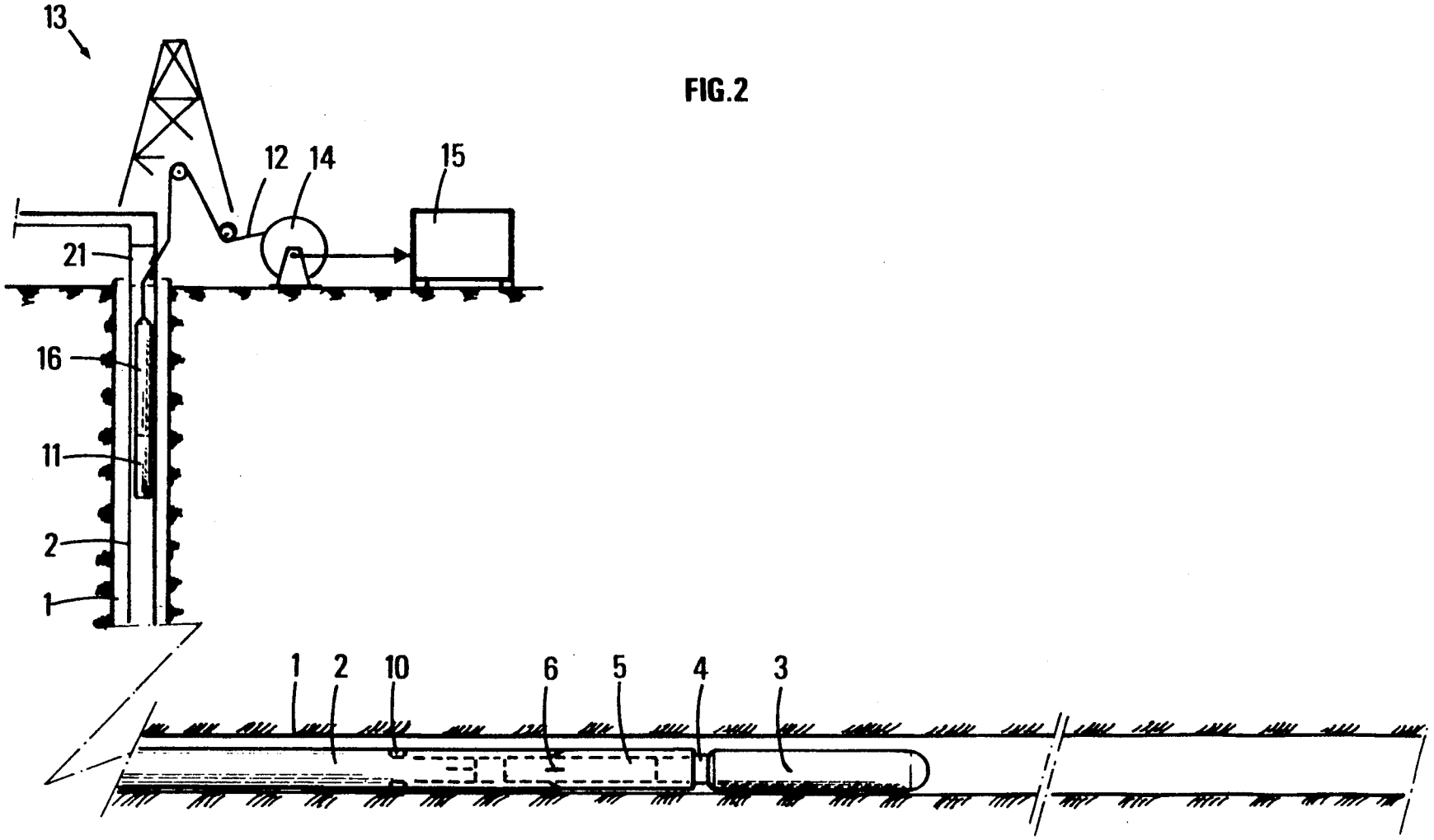
FIG.2 shows a stage at the end of which the intervention tool is brought to its maximum low position.

The intervention tool 3 is fastened (FIG.1) to a first end of a connecting rod 4. The opposite end of this rod 4 is connected, within tubing 2, with a support frame 5 with a section preferably smaller than that of the tubing. Anchoring fingers 6 are mounted pivoted in relation to support frame 5. Under the action of a motor that is not shown, they can be spread out until an opening position (FIG.1) where they get locked in a groove 7 arranged in the inner wall of tubing 2. Support frame 5 comprises, on the side opposite rod 4, a tubular extension 8. A multicontact plug 9 is located in the center of the tubular extension 8 and following its axis. Tubing 2 is fitted with an inner annular pushup 10 which is used for guiding towards plug 9 an appropriate socket 11. The latter is connected with the different conductors of a control cable 12 linked to a surface installation 13 (FIG.2) comprising maneuvering means 14 and a control and recording assembly 15 adapted for recording data picked up by measuring means in intervention tool 3. The socket 11 is topped by a tubular weighting bar 16 with a substantially equal section. Socket 11 also comprises anchoring fingers 17 of a well-known type which can be spread open under the action of electromagnetic means or of an electric motor. Slots 18 for fingers 17 are arranged in the inner wall of tubular extension 8. The fingers can fit within when plug 9 is in a correct plug-in position. The unlocking of fingers 17 allows the translation of support frame 5 by a traction on cable 12 exerted by the surface lifting means 14. Inside support frame 5 and rod 4, conductors (not shown) provide the electric interconnection of cable 12 and of the different electric conductors of the intervention tool.

Examples of electric connectors using this type of multicontact plugs and of adapted socket are described for example in European Patent EP 122 839 or U.S. Pat. No. 4,690,214.

A shaped piping end 18 is added at the lower end of the tubing. Its inner section is slightly larger than that of the support frame. The rod 4 linking the support frame to intervention tool 3 is fitted with a peripheral shoulder 19 with a section substantially equal to the inner section of the tubing, close to the lower end of the latter. When support frame 5 is in the locked position, the shoulder 19 and the shaped piping end 18 cooperate to prevent solid fragments likely to block the opening of the retaining fingers 6 of the support frame from entering the tubing.

The intervention tool 3 is fitted with one or several anchoring arms 20 mounted pivoted in relation to the body of tool 3 and likely to immobilize it in the well in the spread-out position. Each arm 20 is driven by motor means that are not shown and which can be controlled from the surface control 15.

The operations of setting of the intervention tool described above and the running of the operations by means of the tool take place as follows:

- the tool 3 extended by rod 4 is introduced into the end section of tubing 2 and is mechanically and electrically connected with the base of the support frame 5. The latter is positioned in the tubing in such a way that the fingers 6 can be fitted into groove 7 and the shoulder 19 can be located close to the opening of tubing 2. Valve 25 is closed.
- Intervention tool 3, with its support frame 5 locked in tubing 2, is taken down into the well and tubing sections are progressively added to bring it to the upper side of the well zone where operations are to be carried out.
- In this position, at the upper end of the tubing, the multicontact socket 11 connected with transmission cable 12 and topped by its weighting bar 16 is introduced, and a side-entry sub 21 is set through the opening which cable 12 goes through.
- The socket 11 topped by its weighting bar 16 is then taken down into well 1 at the end of control cable 12, either by gravity if it is possible, or driven by pumping until it plugs into multicontact plug 9, as described in the above cited European Patent EP 122 839. The locking of fingers 17 in their slots 18 is then controlled.

Stiff pipe sections are arranged at the upper end of tubing 2 in order to provide the progress of the lower end where tool 3 is located, until the latter substantially reaches the location of its first measuring or/and intervention.

The intervention tool 3 which has reached the position planned for the beginning of the operations is moved away from the end of the tubing by remote controlling from the surface the closing of the anchoring fingers 6 and possibly by setting up a current of fluid in the tubing in order to move the tool away from its first position. This is made possible by unwinding cable lengths through the side-entry sub which it passes freely through.

Figure 3:
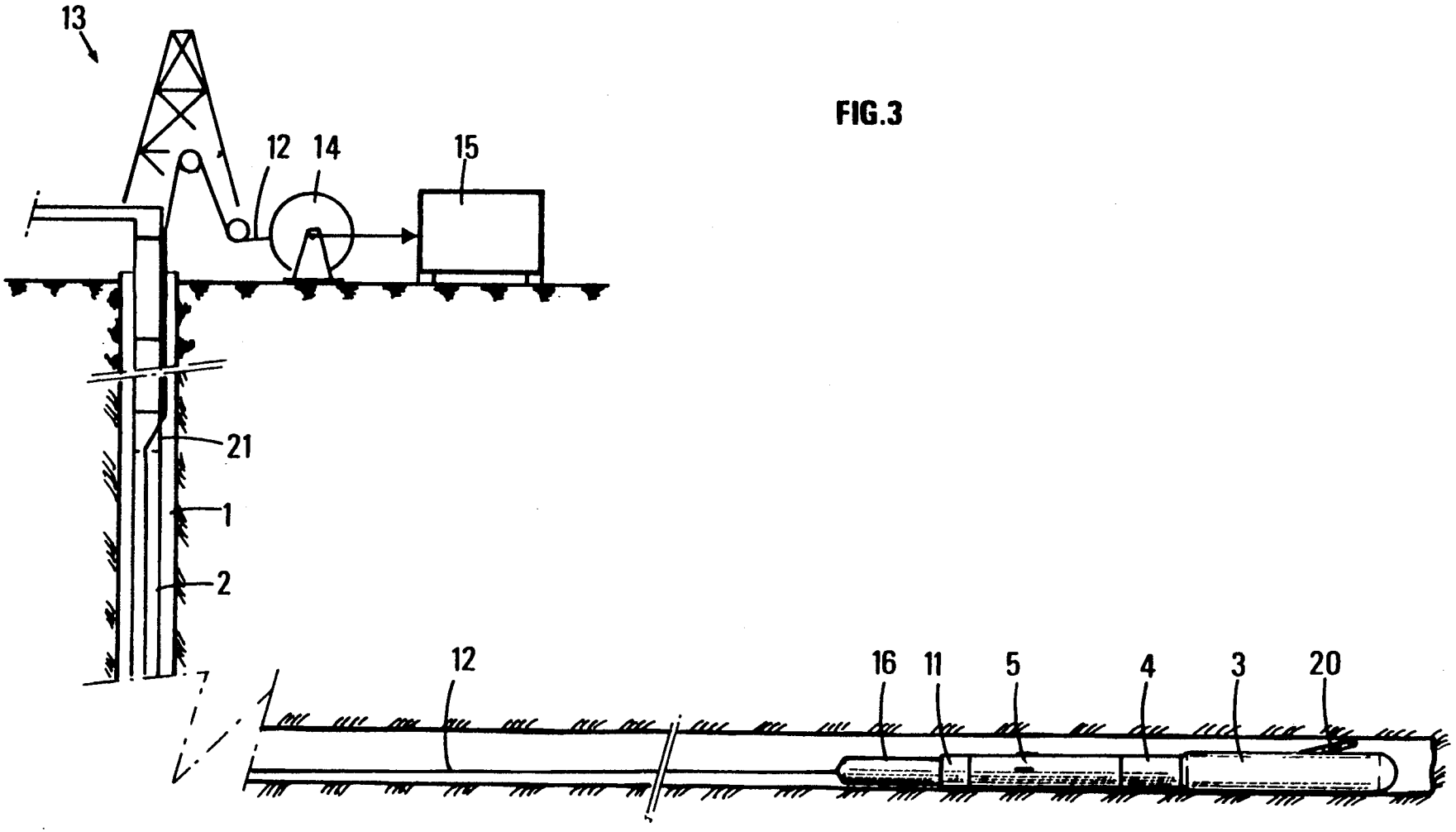
FIG.3 shows another stage where, after the withdrawal of the tubing, the intervention tool is ready to be displaced all along the intervention zone by traction on the cable.

- The opening of the anchoring arms 20 is remote controlled in order to immobilize the measuring tool in the well.
- The tubing is then progressively taken up so that its base reaches the upper part of the well portion where the measurings are carried out (FIG.3).

The measuring tool is then connected to the tubing by means of cable 12 whose length may reach several hundred meters.

The planned interventions can then be carried out. This lay-out makes it possible, if the intervention in progress requires it, to displace the tool all along the useful zone by pulling at the cable by means of a surface lifting device. It is for example possible to achieve continuous loggings on a great length of the well.

In the embodiment procedure described, the intervention tool 3 is linked to its support frame 5 by a stiff rod 4 and it remains outside the tubing 2.

The stiff rod 4 can be replaced by an element of the multiwire cable fitted with a pre-established connection or with a connector that can be plugged in a delayed way in a wet medium like connector (9, 11) without departing from the scope of the invention. Tubing 2 may also be extended at its base with a housing which can contain at least part of the intervention tool 3 without departing from the scope of the invention. The presence of a protective housing is sometimes useful when the well is obstructed or crossed by cavities where the intervention tool may fit in and get blocked. With a stronger protective housing, disengaging operations can be carried out to bring the tool back in line with the well without fearing that it might be damaged.

Using such a cable element, strong enough to withstand the tensile stresses of the tool but still supple enough to avoid transmitting to the body of the tool the vibrations which might be propagated along the stiff tubing, allows to improve the signal to noise ratio of the seismic sensors.

I claim:

1. An improved method for carrying out measuring operations or interventions in wells comprising the use of a stiff tubing comprising a side-entry sub, an intervention assembly comprising at least one tool or measuring instrument; positioning said intervention assembly in a first position at a first end of the stiff tubing with a support frame fitted with removable locking means; introducing the intervention assembly associated with said first end into the well; taking down the intervention assembly into the well by lengthening said stiff tubing until the intervention assembly reaches a zone where measuring or interventions are planned; effecting a delayed electric connection of the intervention assembly with an electric-carrying cable unwound from a surface installation, said cable extending from outside to inside of the stiff tubing via an entry of said side-entry sub; displacing said intervention assembly from the first position to a second position where the intervention assembly is moved away from said first end; and immobilizing, on request, the intervention assembly in the well by anchoring the assembly against the walls of the well; the method further comprising;

utilizing an electric connection means fitted with locking elements for allowing the electric-carrying cable and the support frame, after the frame has been taken down into the well, to be interdependent on request; utilizing said stiff tubing fitted with a piping end having a cross section sufficient to allow the support frame linked to said electric connection means to move totally out of the stiff tubing when said intervention assembly is displaced towards said second position;

withdrawing the stiff tubing after anchoring the intervention assembly in the well on the total length of the measuring or intervention zone, said intervention assembly being directly connected to the surface installation by means of said electric-carrying cable; and withdrawing the intervention assembly until reaching said first position by exerting a traction on the cable with the surface installation until the support frame is locked, after the support frame has totally returned into the stiff tubing.

2. A device for carrying out interventions or measuring operations in wells comprising a stiff tubing fitted with a side entry sub, an intervention assembly comprising at least one tool or measuring instrument and anchoring means for immobilizing the intervention assembly in the well; a support frame associated with said intervention assembly by linking means and displaceable within the tubing between a first position where the intervention assembly lies close to a first end of the tubing and a second position wherein the tubing may be displaced from the intervention assembly, the support frame being fitted with fastening means for locking the support frame onto the tubing in the first position thereof, said fastening means being remotely controlled from a surface installation by means of a multiwire electric-cable linked to a surface control and acquisition assembly and going from outside to inside of the tubing through the side-entry sub; and a system for the delayed connection of said cable with the intervention assembly after said intervention assembly has been taken down into the well and during movement between the first position and the second position, wherein: said tubing is fitted at its first end with a piping end having a cross section sufficient to allow the support frame to be positioned out of the tubing when the fastening means are in the locking position; the delayed connection system comprises a connector that can be plugged in a wet medium and locking means which can be remotely controlled from the surface installation to fix the connector to the support frame in a plugged-in position, and means for limiting access of solid fragments from the well to the fastening means and to the locking means to avoid hindering the operation thereof.

3. A device as claimed in claim 2, wherein the intervention assembly is linked to the support frame by a stiff rod.

4. A device as defined in claim 2, wherein the intervention assembly is linked to the support frame by a supply connection.

5. A device as claimed in any one of claims 2, 3 or 4, wherein the stiff tubing is extended by a housing adapted to contain at least part of the intervention assembly.

* * * * *